US007609210B2

(12) United States Patent
Chen et al.

(10) Patent No.: US 7,609,210 B2
(45) Date of Patent: Oct. 27, 2009

(54) PHASED ARRAY ANTENNA SYSTEM UTILIZING A BEAM FORMING NETWORK

(75) Inventors: Ming Chen, Bellevue, WA (US); Robert L. Wightman, Seattle, WA (US); Dan R. Miller, Seattle, WA (US); Chris D. McKinley, Seattle, WA (US)

(73) Assignee: Boeing Company, Chicago, IL (US)

( * ) Notice: Subject to any disclaimer, the term of this patent is extended or adjusted under 35 U.S.C. 154(b) by 215 days.

(21) Appl. No.: 11/767,129

(22) Filed: Jun. 22, 2007

(65) Prior Publication Data

US 2008/0316143 A1 Dec. 25, 2008

(51) Int. Cl.
*H01Q 1/38* (2006.01)
*H01Q 19/06* (2006.01)

(52) U.S. Cl. ..... 343/700 MS; 343/754; 343/853

(58) Field of Classification Search ..... 343/700 MS, 343/853, 906, 754
See application file for complete search history.

(56) References Cited

U.S. PATENT DOCUMENTS

| | | | | |
|---|---|---|---|---|
| 5,886,671 | A | 3/1999 | Riemer et al. | |
| 5,907,304 | A * | 5/1999 | Wilson et al. | 343/700 MS |
| 6,642,908 | B2 * | 11/2003 | Pleva et al. | 343/876 |
| 7,342,801 | B2 * | 3/2008 | Jandzio et al. | 361/760 |
| 2003/0095066 | A1 | 5/2003 | Brogden | |
| 2003/0137031 | A1 * | 7/2003 | Young et al. | 257/627 |
| 2004/0150554 | A1 | 8/2004 | Stenger | |

FOREIGN PATENT DOCUMENTS

| | | |
|---|---|---|
| EP | 08252104.8-1248 | 10/2008 |
| GB | 865474 A | 4/1961 |
| GB | 2426876 | 6/2006 |
| WO | WO 01/18901 A | 3/2001 |
| WO | WO 03/049231 | 6/2003 |
| WO | WO 2004/051805 | 6/2004 |

OTHER PUBLICATIONS

European Search Report, European Patent Office, Jan. 13, 2009.
David Lynch, Jr., "Introduction to RF Stealth," Scitech Publishing Company, Raleigh, NC, (2004), 5 pages.

* cited by examiner

*Primary Examiner*—Hoang V Nguyen
(74) *Attorney, Agent, or Firm*—Sawyer Law Group PC

(57) ABSTRACT

In accordance with an embodiment, a phased array antenna system includes a printed wiring board formed in rhombic shape that accommodates requirements for low observability and a beam forming network located within the printed wiring board. The beam forming network is located over substantially the entire printed wiring board. The embodiment includes connectors located on the backside of the printed wiring board. The back side connectors allow the array architecture to expand to include more subarrays and therefore allowing for more beam forming elements in a full size array than conventional phased arrays.

14 Claims, 15 Drawing Sheets

PHASED ARRAY ANTENNA SYSTEM UTILIZING A BEAM FORMING NETWORK

CROSS-REFERENCE TO RELATED APPLICATIONS

This application is related to co-pending patent application Ser. No. 11/767,170 filed concurrently on even-date herewith, entitled, "Radio Frequency (RF) Transition Design For A Phased Array Antenna System Utilizing A Beam Forming Network", all of which is incorporated herein by reference.

FIELD OF THE INVENTION

The present embodiments relate generally to beam forming networks and more particularly to phased array antennas utilizing such networks.

BACKGROUND

Active phased array antenna systems are capable of forming one or more antenna beams of electromagnetic energy and electronically steering the beams to targets, with no mechanical moving parts involved. A phased array antenna system has many advantages over other types of mechanical antennas, such as dishes, in terms of beam steering agility and speed, low profiles, low observability, and low maintenance.

A beam forming network is a major and critical part of a phased array antenna system. The beam forming network is responsible for collecting all the electromagnetic signals from the array antenna modules and combining them in a phase coherent way for the optimum antenna performance. The element spacing in a phased array is typically at one-half of the wavelength for electromagnetic waves in space.

There are design challenges when utilizing a phased array antenna system. Firstly, it is important that the phased array include a rhombic shape of aperture for low observabilty requirements of the system. In addition, the system should be as small as possible to conserve space while still having the same performance characteristics of conventional shaped phased array antenna systems. Furthermore, as array antenna frequency increases, the element spacing decreases in an inversely proportional manner. Due to this tight spacing in phased arrays at microwave frequencies, transitions of radio frequency (RF) energy from inside of the beam forming network printed wiring board to the backside of the antenna have always been one of the critical RF design factors in phased array development. Conventional designs had tighter tolerances in the feature alignments of the RF transition, which limits the choice of suppliers for the systems and impacts the cost and schedule for producing the antennas as well.

What is needed is a method and system to overcome the above-identified issues. One or more of the present embodiments address one or more of the above-identified needs and others.

The features, functions, and advantages can be achieved independently in various embodiments of the present invention or may be combined in yet other embodiments.

SUMMARY OF THE INVENTION

One or more systems and methods for forming phased array beams are disclosed. According to one or more embodiments, a system and/or method includes a multilayer printed wiring board in a rhombic shape, a beam forming network located within the printed wiring board, and a RF transition from the board to the backside of the phased array antenna.

The beam forming network comprises at least one subarray. The rhombic shape accommodates requirements for low observability. The system further includes back side interconnections that allow the array architecture to expand to include more subarrays and therefore allowing for more beam forming elements in a full size array than conventional phased arrays.

According to one embodiment, a phased array antenna system includes a printed wiring board formed in rhombic shape that accommodates requirements for low observability. A beam forming network located within the printed wiring board, wherein the beam forming network is located over substantially the entire printed wiring board and connectors located on the backside of the printed wiring board that allows for expansion of the system.

According to another embodiment, a method includes providing a printed wiring board formed in a rhombic shape providing a beam forming network located within the printed wiring board, wherein the beam-forming network is located over substantially the entire printed wiring board and providing connectors only on the back side of the printed wiring board to allow for expansion of the phased array beams.

DETAILED DESCRIPTION

Figure 1A:
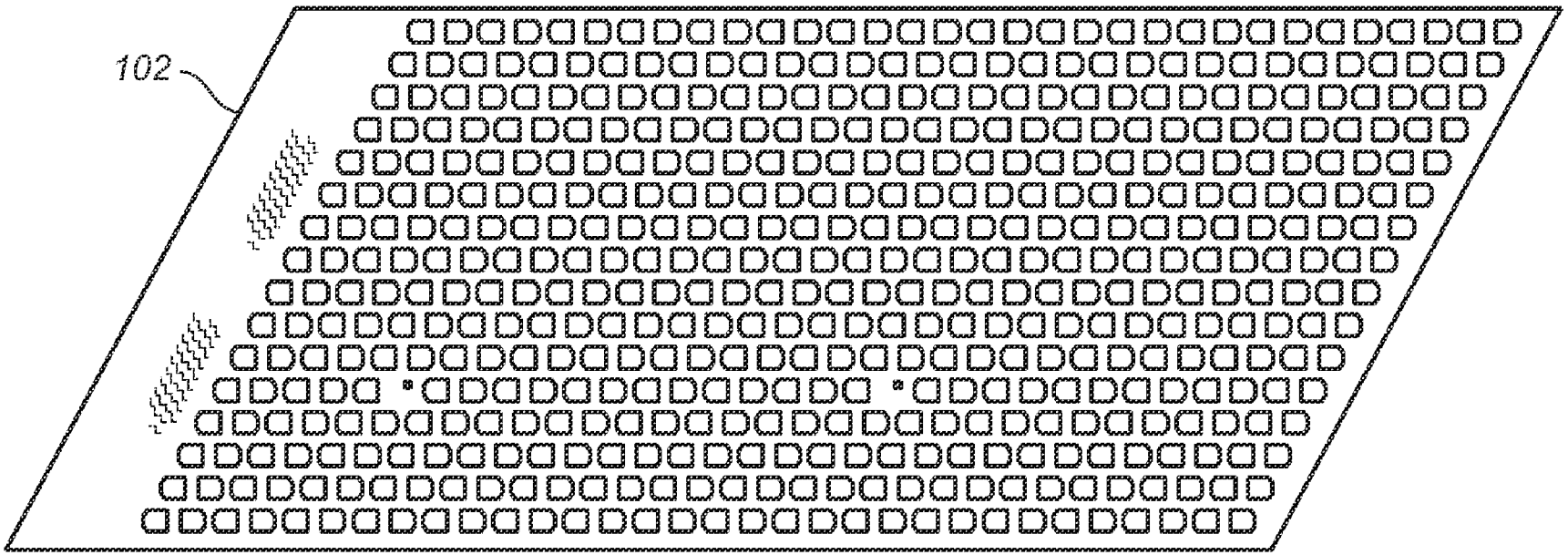
FIG. 1A is a mechanical schematic of one embodiment of a beam forming network within a printed wiring distribution board which has a rhombic shape, according to an embodiment.

The present embodiment relates generally to beam forming networks and more particularly to phased array antennas utilizing such networks. The following description is presented to enable one of ordinary skill in the art to make and use the embodiment and is provided in the context of a patent application and its requirements. Various modifications to the embodiments and the generic principles and features described herein will be readily apparent to those skilled in the art. Thus, the present embodiment is not intended to be limited to the embodiments shown, but is to be accorded the widest scope consistent with the principles and features described herein.

Every phased array antenna system includes a beam forming network to coherently combine the signals from all of its many elements. It is this signal combining ability that forms the electromagnetic beam. A beam forming distribution board for a conventional phased array antenna system has a rectangular shape for the beam forming network. As is known the rectangular shape provides problems because it is easily observable electronically due to its electronic signature. Hence it is desirable for the phased array antenna system to be rhombic in shape to allow for low observability.

Active electronically scanned phased arrays have been produced that contain a large number of phased array elements. For example, The Boeing Company has produced such a phased array antenna system that contains 4,096 elements in 8 subarrays arranged in a 2×4 configuration.

In a conventional receive phased array antenna system all of the DC power and logic interconnections are placed at the outside edges of the subarray. One cannot add more subarray columns to increase the size without having large gaps in-between adjacent subarrays. In conventional phased array antenna systems such as K-band arrays, the rhombic shape of aperture for phased array antennas were accomplished by either using the metal plate itself, (which offered only the minimum benefit to the low observability), or having passive dummy elements placed around the rectangular shape of active elements.

There are four critical features in that distinguish the beam forming network of the present embodiment over conventional beam forming networks:

(1) A rhombic shape of the beam forming network subarray that accommodates requirements for low observability and utilizes beam forming elements over substantially the entire array.

(2) Reduced the column and row gaps in between the subarray panels, with improved results on the antenna beam patterns.

(3) Improved RF bandwidth and mechanical tolerances in the RF transition from the beam forming network to the backside of the array.

(4) Back side interconnections that allow the array architecture to expand to include more subarrays and thus more elements in a full size array.

A phased array antenna system in accordance with an embodiment expands the capabilities of phased array antenna systems in two critical areas: (1) providing a low observability compliant phased array aperture with reduced size, weight and cost; and (2) providing a beam forming network scalability to large full-size arrays. Both capabilities allow for the enhanced phased array antennas utilized for a variety of applications. To describe the features of the phased array antenna system refer now to the following description in conjunction with the accompanying figures.

Figure 1B:
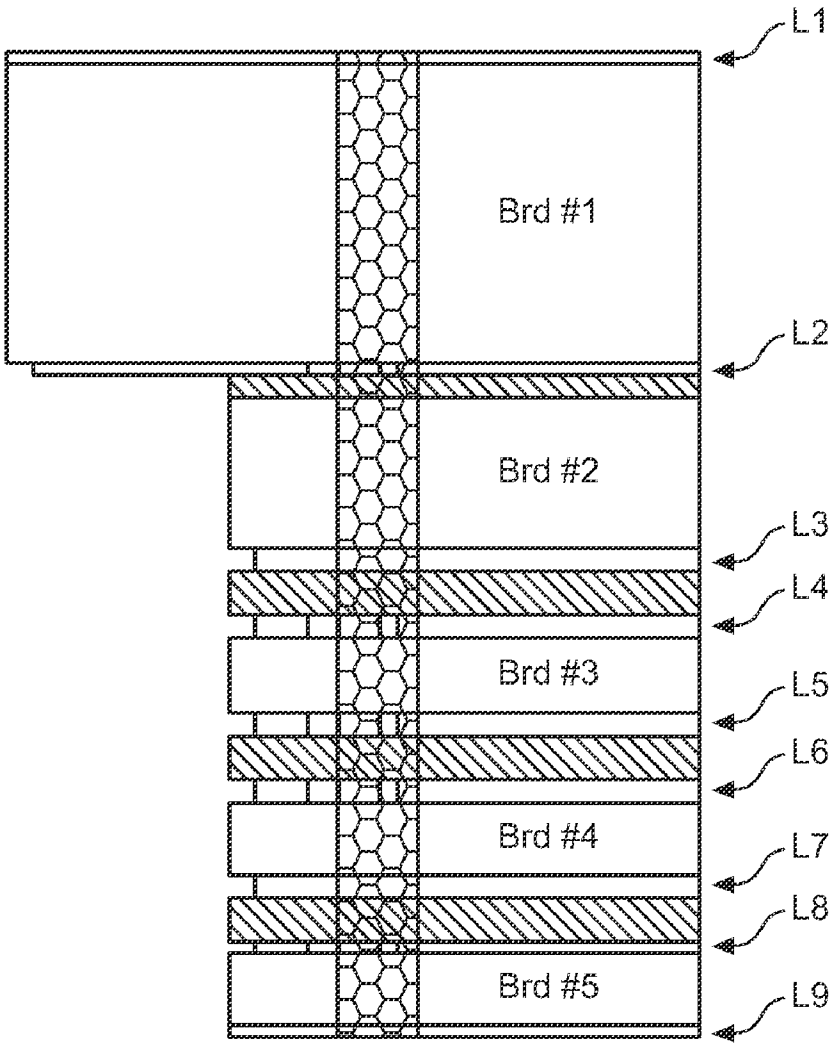
FIG. 1B illustrates the layers associated with the printed wiring board of FIG. 1A.

FIG. 1A is a mechanical schematic of one embodiment of a beam forming network 100 within a printed wiring board 102. The beam forming network 100 is formed inside a rhombic shape printed wiring board (PWB) 102, so that two or more of such identical boards can be put together to form a larger sized array without compromising the low observability characteristics. In this embodiment, the rhombic shape of the aperture is covered with active beam forming elements for a maximum cost effective benefit to the antenna system. In an embodiment, the PWB 102 includes nine layers as shown in FIG. 1B.

Figure 2:
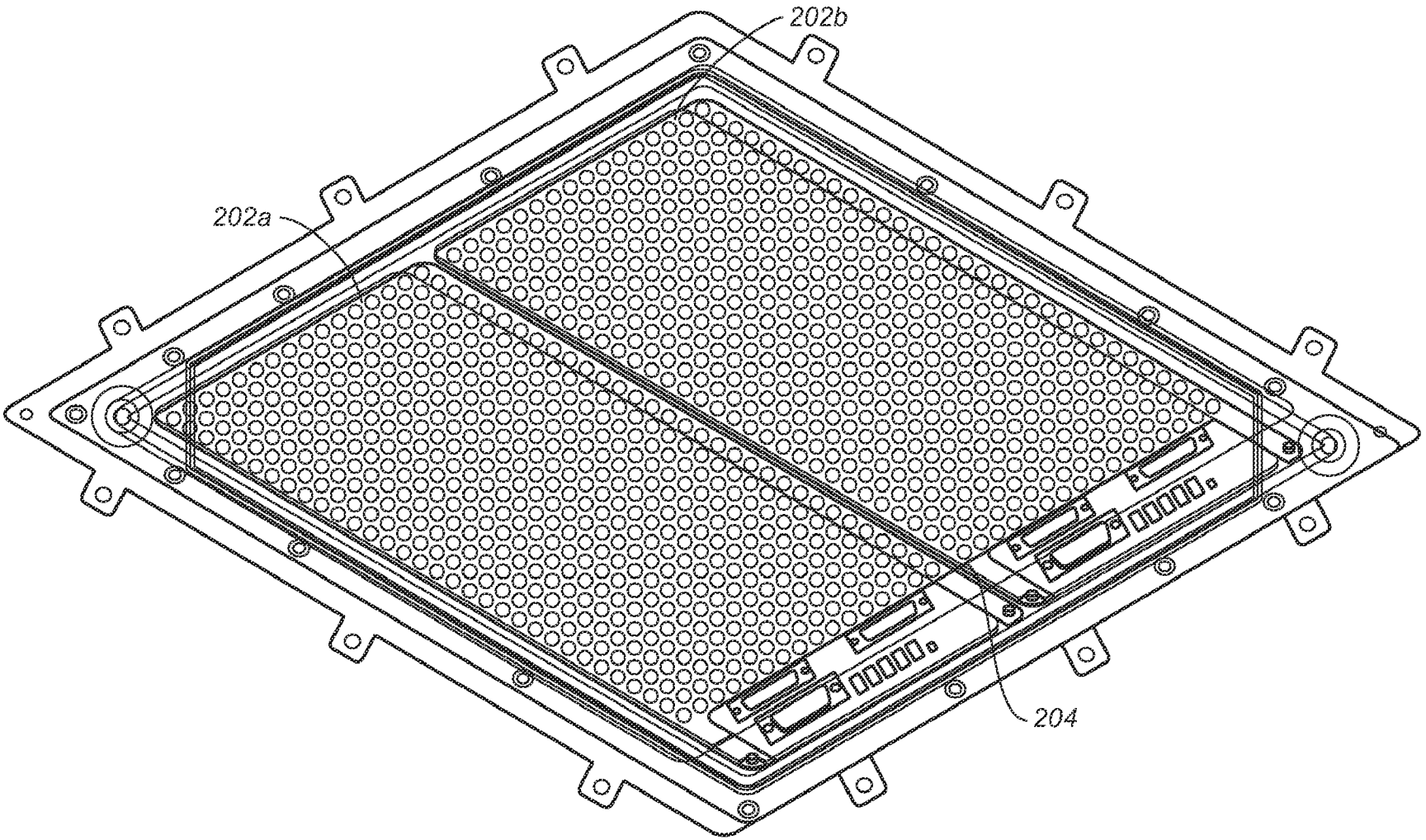
FIG. 2 is a mechanical schematic of the receive phased array antenna system with two subarrays of the beam forming network as shown in FIG. 1A.

FIG. 2 is a mechanical schematic of the receive phased array antenna system 200 with two subarrays 202*a* and 202*b* of the beam forming network, according to an embodiment. One critical feature is the narrowing of the non-active-element gaps around each board when two or more identical PWBs are put together to form large arrays. FIG. 3 shows that the edge gaps 204 in-between the adjacent boards are of only one element spacing, as compared with two element spacing in the conventional phased arrays. This reduction in the gap width improves the antenna beam patterns. The reduction of gap width is accomplished by laying out the beam forming circuits of the subarrays 202*a* and 202*b* in a more efficient manner. Also, by placing all of the circuitry and connectors on the backside adjacent subarrays, the subarrays can be placed closer together than the subarrays utilized in a conventional phased array antenna system.

Figure 3A:
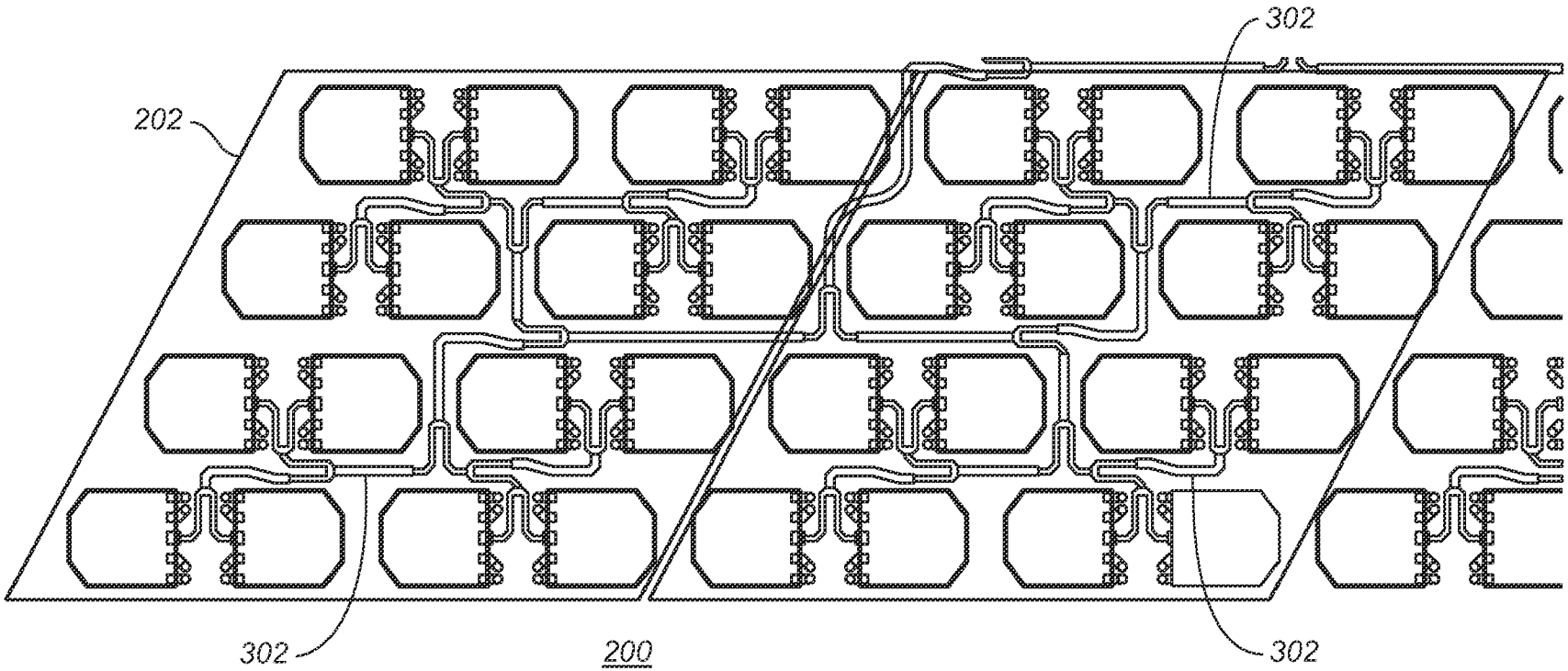
FIG. 3A is a diagram view of the beam forming network RF circuits inside the beam former printed wiring board, according to an embodiment.
Figure 3B:
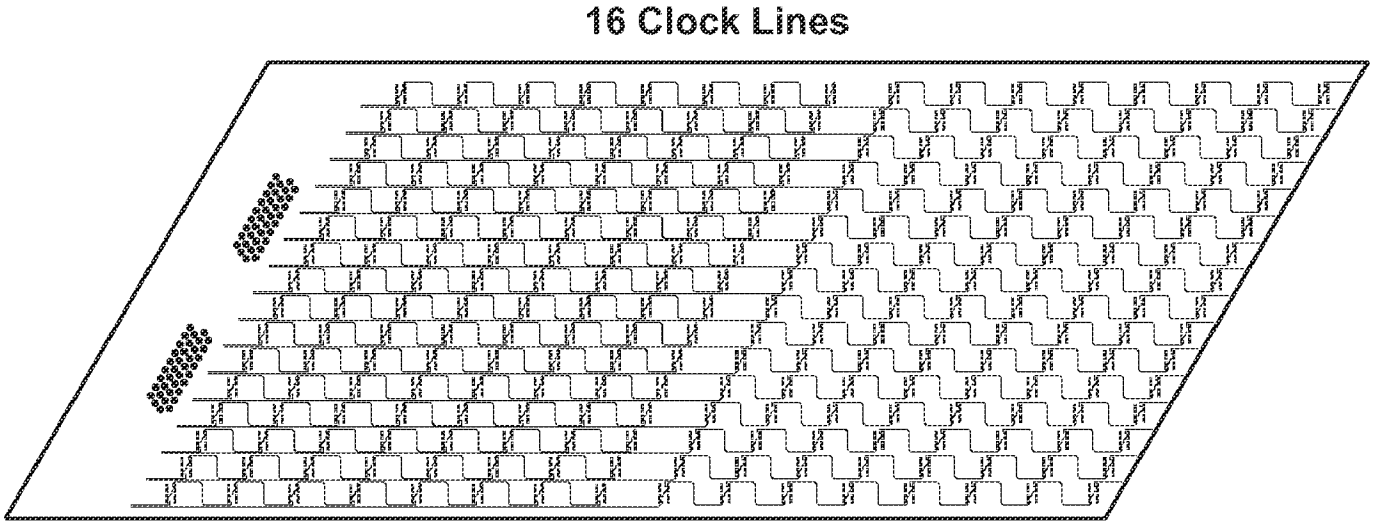
FIG. 3B shows the octagonal arrangement of clock lines on the beam former printed wiring board, according to an embodiment.
Figure 3C:
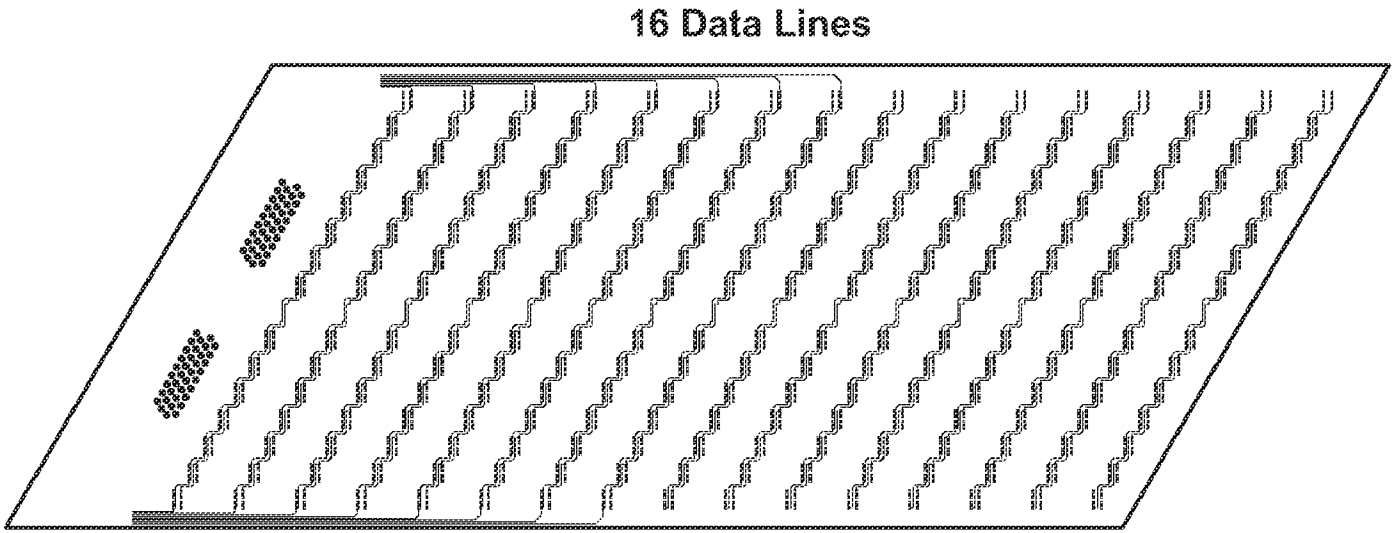
FIG. 3C shows the octagonal arrangement of data lines on the beam former printed wiring board, according to an embodiment.

FIG. 3A is a diagram of a portion of the beam forming network circuits 200 inside the PWB 202. FIG. 3A shows stripline traces 302 on the RF layer 300 embedded inside the printed wiring board 202. These stripline traces 302 form the RF distribution network for the beam forming function. As is seen in FIGS. 3B and 3C, the data and clock lines are arranged in an orthogonal style to provide a more efficient layout on the PWB 202 and more robust signal integrity for array's beam steering control.

Figure 4:
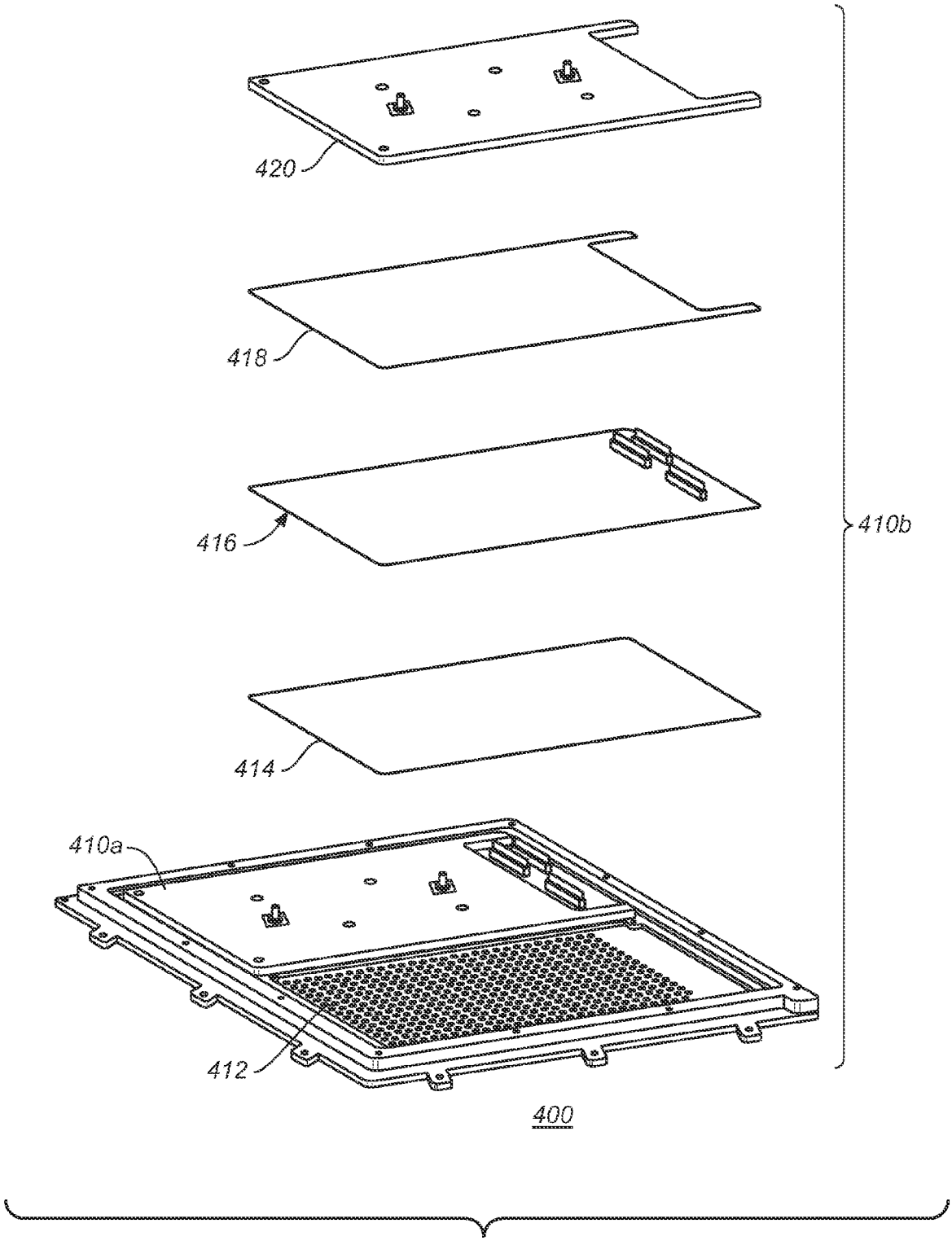
FIG. 4 is a diagram of a receive phased array antenna assembly, according to an embodiment.
Figure 5:
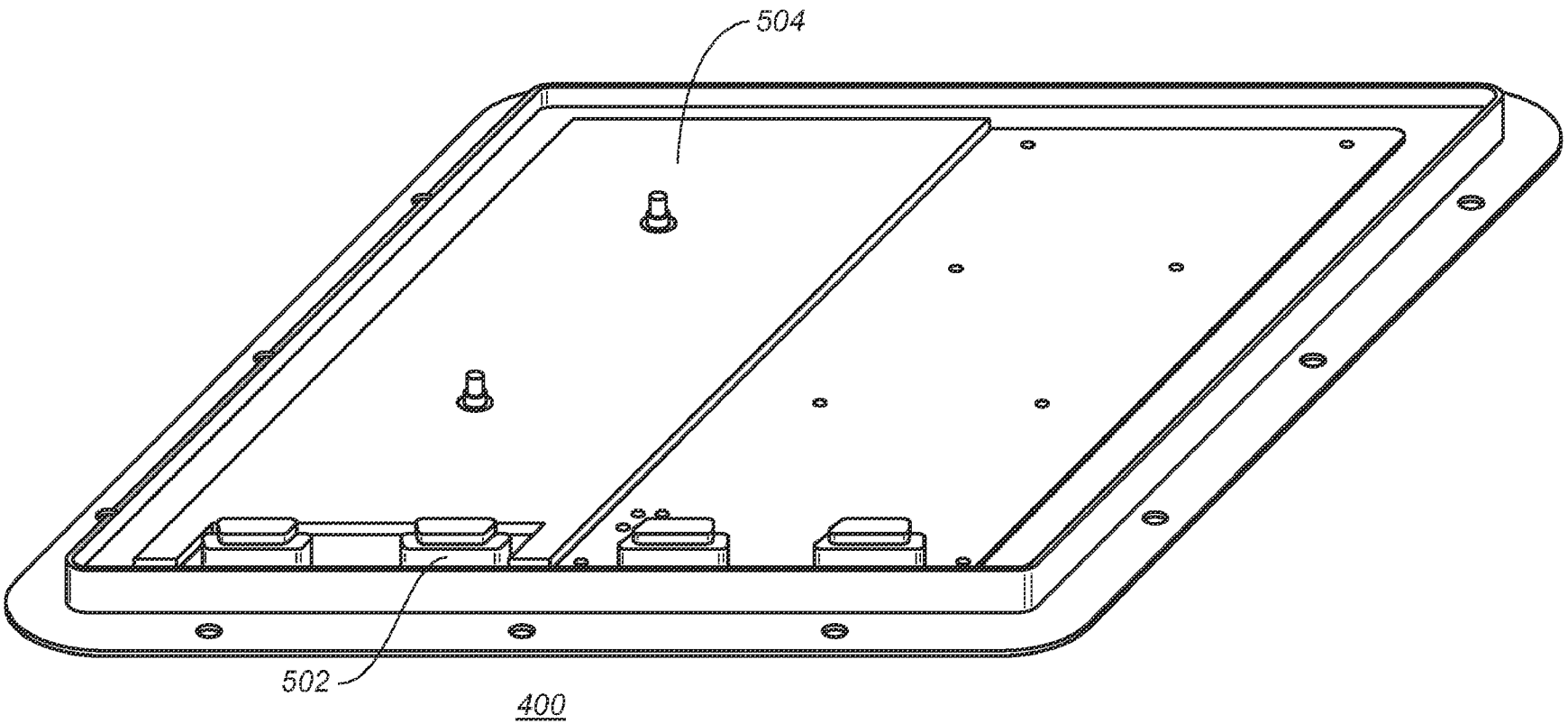
FIG. 5 illustrates the back side of the phased array antenna system that shows the back side connectors for DC power and logic, and the coaxial connectors for radio frequency (RF) signals, according to an embodiment.

The array assembly and the backside interconnections for the phased array antenna system are shown in FIG. 4 and FIG. 5. FIG. 4 is a diagram of a receive phased array antenna assembly 400. In this embodiment one subarray 410*a* is shown assembled and one subarray 410*b* is shown in exploded view. As is seen the subarray 410*b* includes a plurality of subarray elements 412, a module shim 414, a multilayer wiring board (MLWB) 416, an elastomer connector shim 418 and a pressure plate with thermal transfer material 420. The MLWB is utilized advantageously to provide the RF, power and logic distribution for the phased array antenna. These elements are coupled together as shown in subarray 410*a* to provide the rhombic shaped array.

FIG. 5 illustrates the back side of the phased array antenna system showing the back side connectors for DC/logic connector 502, and the RF port coaxial connector 504 for the RF signals. By including these connectors on the back side of the board the subarrays can be placed closer together. The RF port connector provides for an RF transition for the beam forming network printed wiring board and the array housing. As before mentioned, in conventional subarrays, the connectors are placed on the sides of the PWB thereby causing adjacent subarrays to be placed at a distance from each other based upon the size of the connectors. In one embodiment there is one port per each subarray. A phased array antenna system in accordance with an embodiment expands the capabilities of phased array antenna systems in two critical areas: (1) providing a low observability compliant phased array aperture with reduced size, weight and cost; and (2) providing a beam forming network scalability to large full size arrays. Both capabilities allow for the enhanced phased array antennas utilized for a variety of applications. The embodiment includes a RF transition module that two key improvements over the previous RF transition modules:

(1) improved RF bandwidth with more tuning range by selecting the optimum material dielectric constant for the tuning block.

(2) more relaxed mechanical tolerances in the RF transition from the beam forming network to the backside of the array, thus making the board more manufacturable, with lower cost. To describe the features of the RF transition module in more detail refer now to the following description in conjunction with the accompanying figures.

The RF distribution network constructed inside the PWB for the beam forming function is shown in FIG. 3A. The RF traces are connected at each 256-element level to the transition module 600 shown above in FIG. 6.

Figure 6:
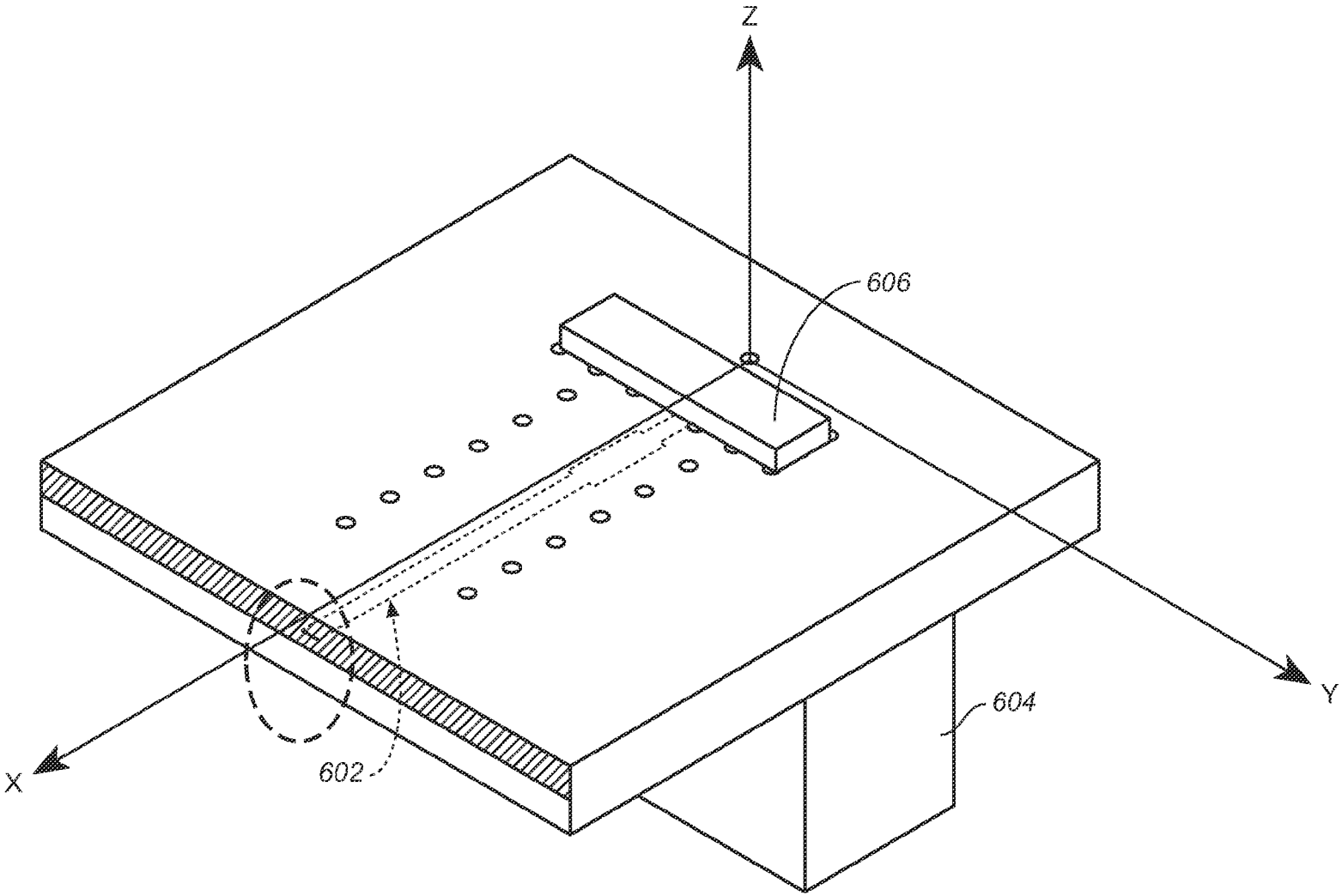
FIG. 6 is a perspective view of a stripline to waveguide transition module in accordance with an embodiment.
Figure 7A:
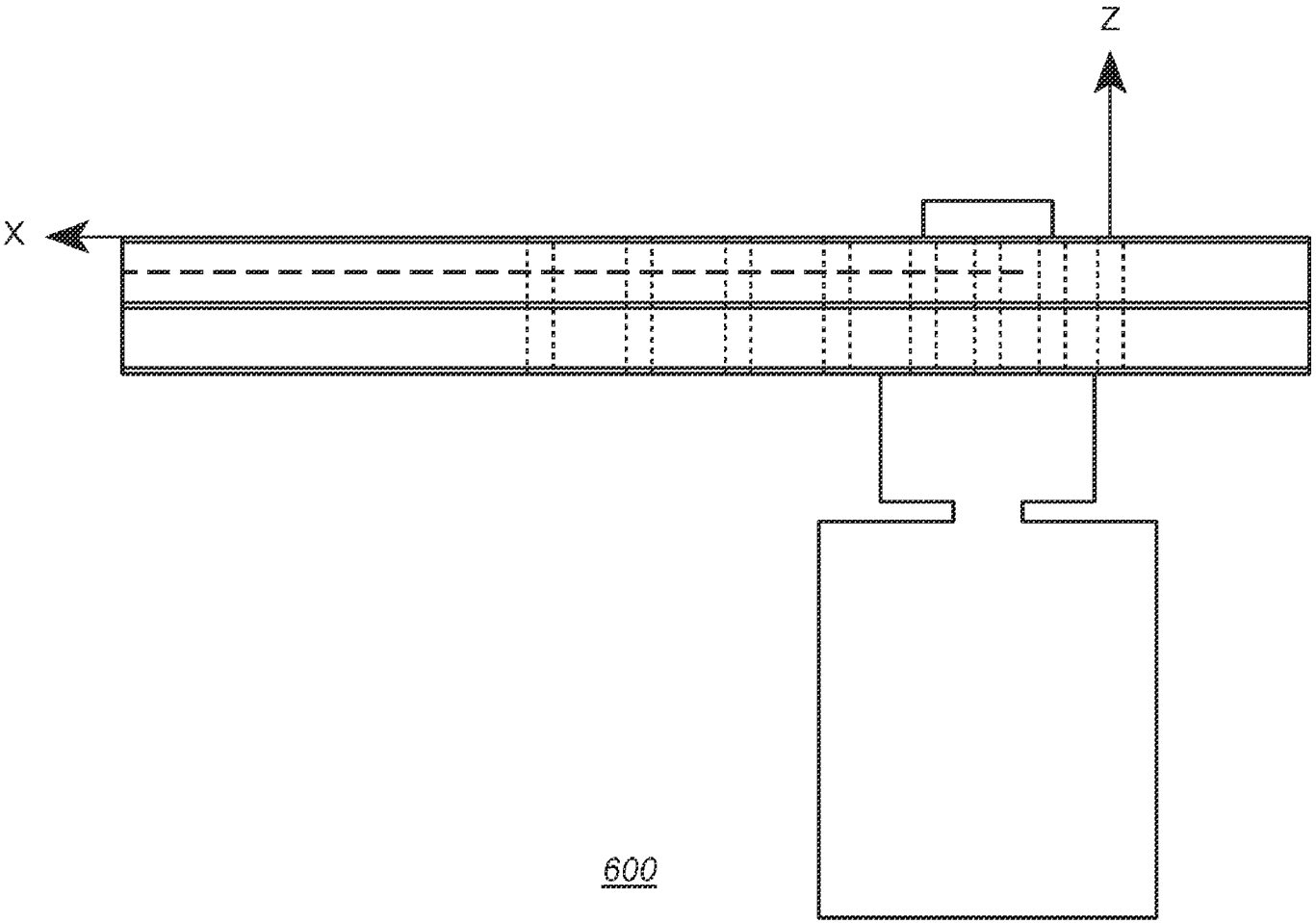
FIG. 7A shows a side view of an RF transition module, according to an embodiment.
Figure 7B:
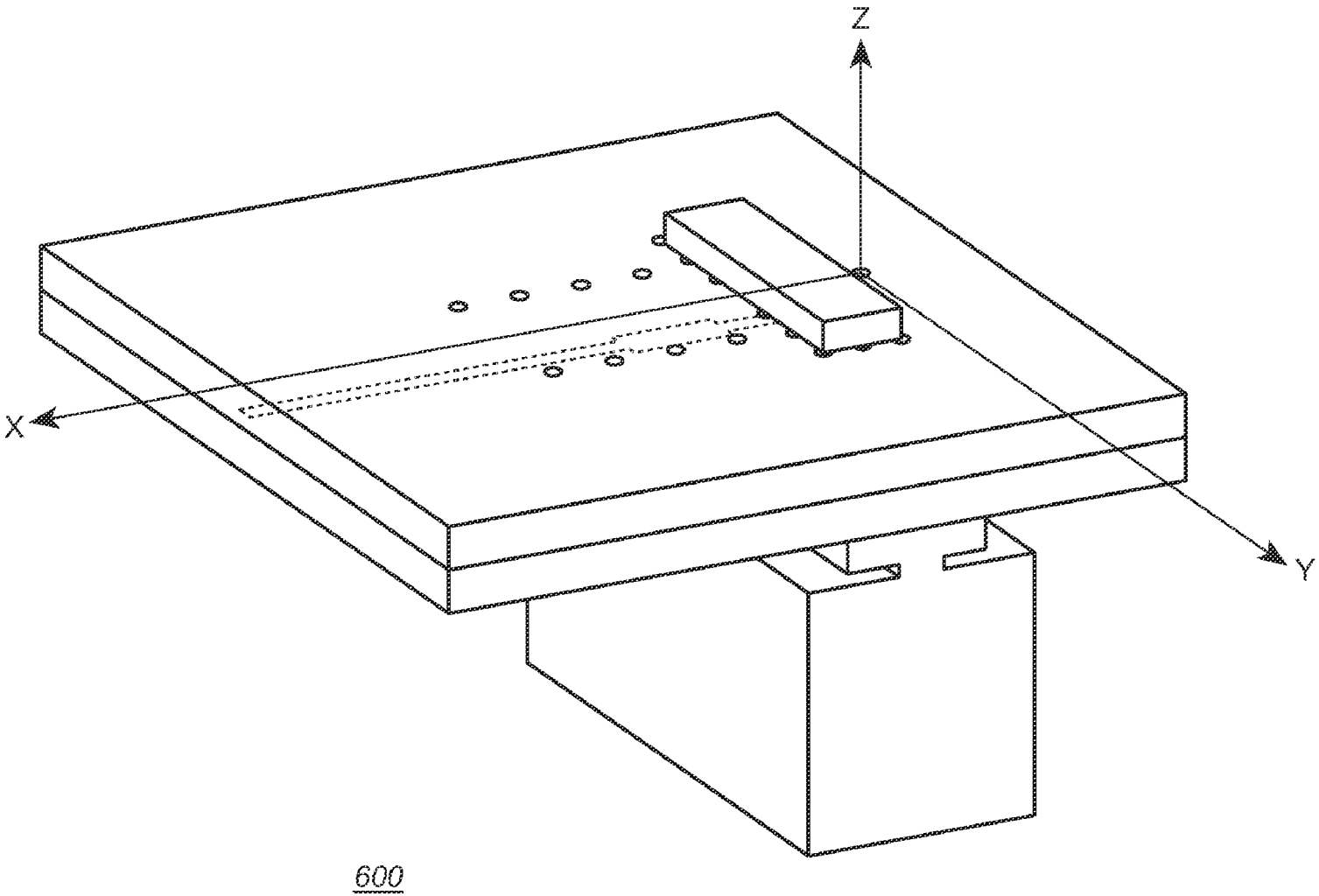
FIG. 7B shows an isometric view of the RF transition module.
Figure 7C:
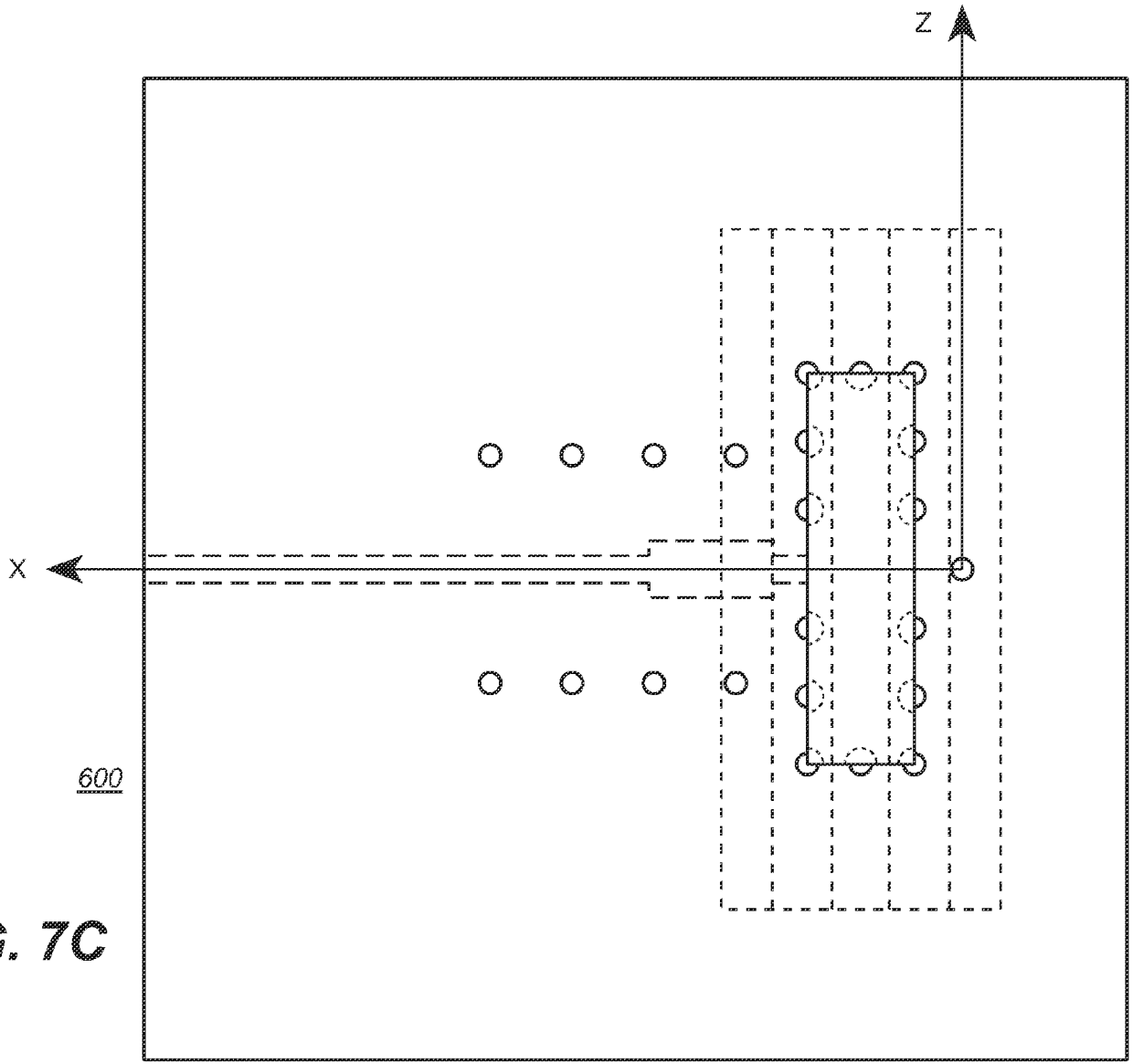
FIG. 7C shows a plan view of the RF transition module.
Figure 7D:
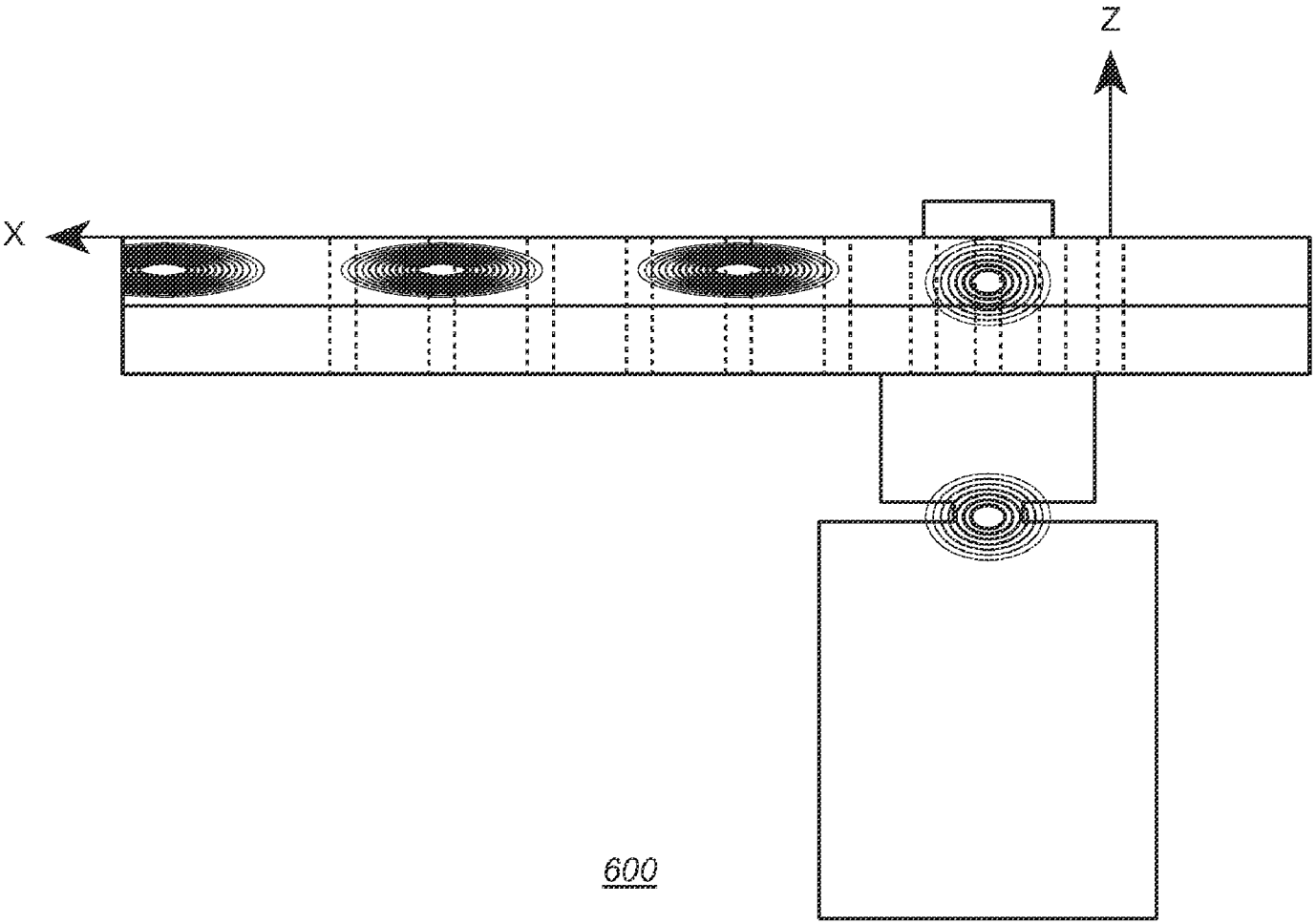
FIG. 7D shows an electromagnetic field distribution inside the RF transition module.

FIG. 6 is a perspective view of a stripline to waveguide RF transition module 600 in accordance with one or more embodiments. FIG. 7A shows a side view of the RF transition module 600. FIG. 7B shows an isometric view of the RF transition module 600. FIG. 7C shows a plan view of the RF transition module 600. FIG. 7D shows an electromagnetic field distribution inside the RF transition module 600. As is seen, the RF energy comes in along the stripline 602 (Port 1) and is coupled into the rectangular waveguide 604 (Port 2). The rectangular block 606 placed above the trace represents the dielectric material that is inserted in a can (not shown). The delicate material 606 tunes the transition coupling performance by varying the material dielectric properties. In one embodiment, the RF transition module comprises a stripline trace section with openings in the nearby ground planes forming a quarter-wavelength resonator. The RF energy from the stripline is electromagnetically coupled to either a rectangular wavelength piece or a coaxial contact.

This RF transition module 600 is integrated in the beam-forming-network-printed-wiring-board. The rhombic shape beam forming network printed wiring board is shown in FIG. 1A. Inside each PWB, two RF transition modules are integrated with the phased array. The transition modules are responsible for combining the elements in one subarray. In one embodiment the subarray includes 256 elements.

Figure 8:
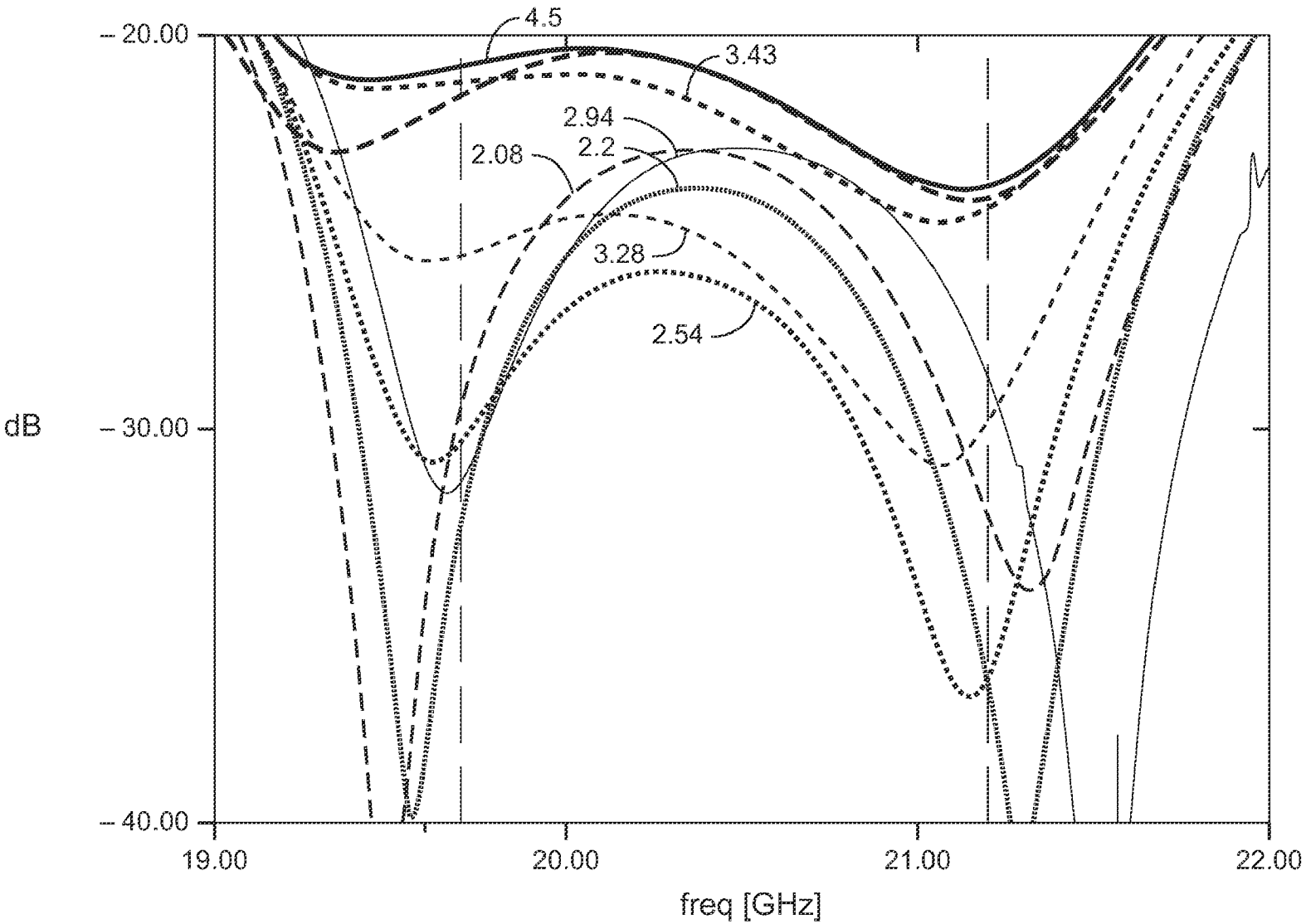
FIG. 8 represents the results of a finite-element electromagnetic field simulation within the waveguide transition module shown in FIG. 6.

FIG. 8 represents the results of a finite-element electromagnetic field simulation within the RF waveguide transition structure shown in FIG. 6. The insert material simulated includes Teflon, Taconic, Rexolite, Rogers Duroid, and Arlon Coefficient of Linear Thermal Expansion (CLTE). The insert material is simulated by varying its dielectric constant and the return losses for the RF transition are plotted as a function of the RF frequency. All materials within the numerical analysis result in a "double null" pattern across the frequency band of interest—this is a desirable characteristic because it means less reflection, better impedance matching, and wider bandwidth in the desired frequency range. FIG. 8 indicates that a return loss of 20 dB or better has been achieved over more than 2 GHz frequency range—better than 10% bandwidth at K-band (20 GHz). This is a significant improvement in operation bandwidth from previous designs.

Figure 9A:
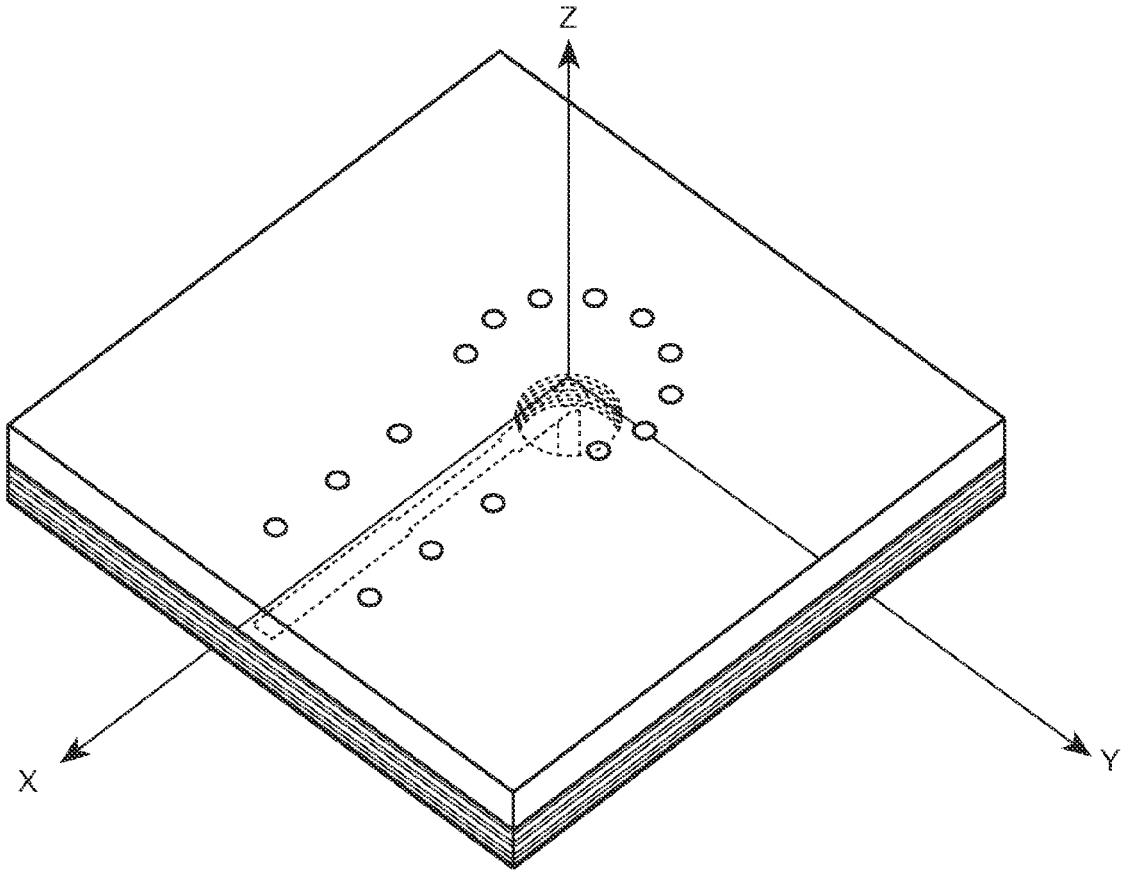
FIG. 9A shows a perspective view of a stripline to coaxial module which also includes a coaxial interface.
Figure 9B:
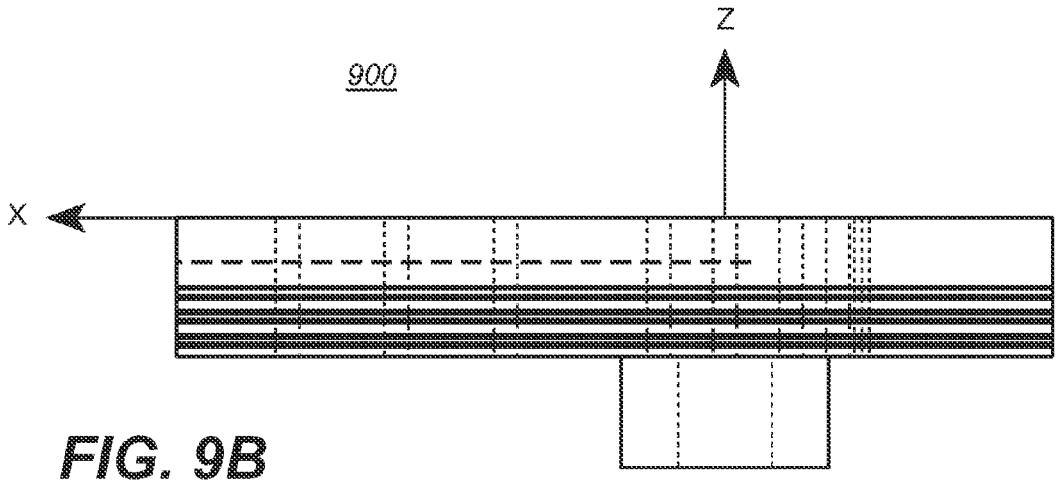
FIG. 9B shows a side view of the stripline to coaxial module which includes a coaxial interface.
Figure 9C:
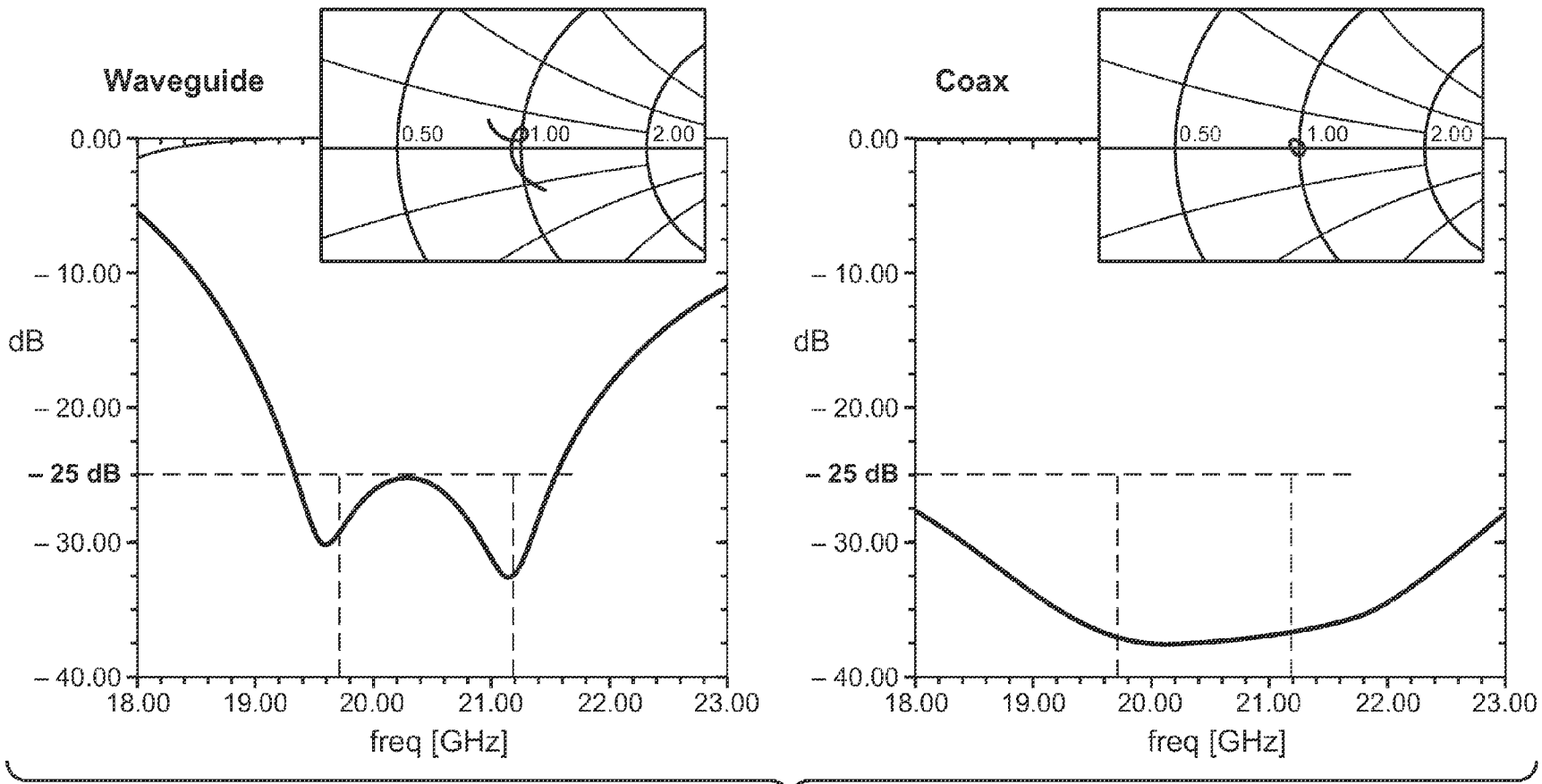
FIG. 9C shows the performance comparison of the stripline to waveguide module and the stripline to coaxial module.

Another RF transition design comprising a low cost commercial off-the-shelf (COTS), surface mount coaxial connector has also been used for the same stripline matching network, i.e., the coaxial matching has been successfully simulated and compared. For the coaxial cases, the compact impedance match circuit occupies less than one-half the space as for the waveguide case. The waveguide transition module occupies four times the width, but about the same height as the coaxial connector. FIGS. 9A and 9C show a perspective view and side view of a stripline to coaxial module 900 which also includes a coaxial interface. FIG. 9B shows the performance of the stripline to waveguide module and the stripline to coaxial connector transition module.

As is seen, desirable characteristics of these transition modules display wide bandwidth while having a below −25 dB return loss. The waveguide transition module is less sensitive to trace width/length variance, representing manufacturing tolerance fluctuation. Overall, the above-identified modules are simpler structures and less costly than conventional transition modules. Also, the new coaxial transition module is easier to manufacture thereby reducing the cost and the schedule risk associated with manufacturing of the beam forming network.

A phased array antenna system in accordance with an embodiment expands the capabilities of phased array antenna systems in two critical areas: (1) providing a low observability compliant phased array aperture with reduced size, weight and cost; and (2) providing a beam forming network scalability to large full size arrays. Both capabilities allow for the enhanced phased array antennas utilized for a variety of applications.

Although the present embodiment has been described in accordance with particular embodiments, one of ordinary skill in the art will readily recognize that there could be variations to the embodiments and those variations would be within the spirit and scope of the present embodiment. Accordingly, many modifications may be made by one of ordinary skill in the art without departing from the spirit and scope of the appended claims.

What is claimed is:

1. A phased array antenna system comprising:

a printed wiring board formed in rhombic shape that accommodates requirements for low observability;

a beam forming network located within the printed wiring board, wherein the beam forming network is located over substantially the entire printed wiring board, wherein the beam forming network includes at least one subarray of a plurality of beam forming elements, wherein data and clock lines of the beam forming elements are arranged in an orthogonal style to provide an efficient layout of the printed wiring board and robust signal integrity for the array beam steering control;

wherein the subarray comprises a plurality of subarray elements, a module shim coupled to the plurality of subarray elements, a multilayer wiring board coupled to the module shim, a connector shim coupled to the multilayer wiring board; and a pressure plate coupled to the connector shim, wherein two or more subarrays are coupled together to provide a rhombic shaped array;

and connectors located on the backside of the printed wiring board that allows for expansion of the system.

2. The phased array antenna system of claim 1 wherein the non-active element gaps between at least two subarrays are minimized.

3. The phased array antenna system of claim 1 wherein the multilayer wiring board provides radio frequency (RF) power and logic distribution for the phased array antenna system.

4. The phased array antenna system of claim 1 wherein the interconnections on the back side of the array comprises a direct-current (DC)/logic connector and an RF port connector.

5. The phased array antenna system of claim 4 wherein the RF port connector provides for an RF transition for the beam forming network.

6. The phased array antenna system of claim 5 wherein the RF port connector comprises a coaxial connector.

7. A method for forming a phased array beam comprising:

providing a printed wiring board formed in a rhombic shape;

providing a beam forming network located within the printed wiring board, wherein the beam-forming network is located over substantially the entire printed wiring board, wherein the beam forming network includes at least one subarray of a plurality of beam forming elements, wherein data and clock lines of the beam forming elements are arranged in an orthogonal style to provide an efficient layout of the printed wiring board and robust signal integrity for the array beam steering control;

wherein each subarray comprises a plurality of subarray elements, a module shim coupled to the plurality of subarray elements, a multilayer wiring board coupled to the module shim, a connector shim coupled to the multilayer wiring board; and a pressure plate coupled to the connector shim, wherein two or more subarrays are coupled together to provide a rhombic shaped array;

and providing connectors only on the back side of the printed wiring board to allow for expansion of the phased array beams.

8. The method of claim 7 wherein the non-active element gaps between the at least two subarrays are minimized.

9. The method of claim 7 wherein the multilayer wiring board provides RF power and logic distribution for the phased array antenna system.

10. The method of claim 7 wherein the interconnections on the back side of the array comprises a DC/logic connector and an RF port connector.

11. The method of claim 10 wherein the RF port connector provides for an RF transition for the beam forming network.

12. The method of claim 11 wherein the RF port connector comprises a coaxial connector.

13. The method of claim 10, wherein the RF traces of the RF distribution network are coupled to the RF Port connector.

14. The method of claim 7 which includes laying out the beam array elements in a manner to minimize the distance between adjacent subarrays.

* * * * *